US011616330B2

(12) United States Patent
Herring et al.

(10) Patent No.: US 11,616,330 B2
(45) Date of Patent: Mar. 28, 2023

(54) POWER CONNECTOR ASSEMBLY

(71) Applicant: TE Connectivity Services GmbH, Schaffhausen (CH)

(72) Inventors: Michael David Herring, Apex, NC (US); Robert Patterson, Harrisburg, PA (US)

(73) Assignee: TE CONNECTIVITY SOLUTIONS GMBH, Schaffhausen (CH)

( * ) Notice: Subject to any disclaimer, the term of this patent is extended or adjusted under 35 U.S.C. 154(b) by 21 days.

(21) Appl. No.: 17/330,944

(22) Filed: May 26, 2021

(65) Prior Publication Data

US 2022/0385013 A1 Dec. 1, 2022

(51) Int. Cl.

| | |
|---|---|
| ***H01R 25/16*** | (2006.01) |
| ***H01R 13/621*** | (2006.01) |
| ***H01R 12/58*** | (2011.01) |

(52) U.S. Cl.

CPC ..... *H01R 25/162* (2013.01); *H01R 12/585* (2013.01); *H01R 13/6215* (2013.01)

(58) Field of Classification Search

CPC .. H01R 25/162; H01R 25/585; H01R 25/161; H01R 12/585; H01R 12/59; H01R 12/5851; H01R 12/50; H01R 13/6215; H01R 25/16

See application file for complete search history.

(56) References Cited

U.S. PATENT DOCUMENTS

| | | | | |
|---|---|---|---|---|
| 2,752,580 | A * | 6/1956 | Shewmaker | H05K 3/368 174/262 |
| 4,353,609 | A * | 10/1982 | Haas | H01R 12/718 439/82 |
| 4,446,505 | A * | 5/1984 | Long | H05K 3/368 439/387 |
| 4,495,380 | A * | 1/1985 | Ryan | H05K 7/142 24/453 |
| 4,911,645 | A * | 3/1990 | August | H01R 12/82 439/82 |
| 4,986,607 | A * | 1/1991 | Hofmann | F16C 19/187 384/537 |
| 5,073,118 | A * | 12/1991 | Grabbe | H05K 3/325 439/82 |
| 5,139,446 | A * | 8/1992 | Costello | H01R 13/42 439/82 |
| 5,761,050 | A * | 6/1998 | Archer | H01R 12/523 361/791 |
| 6,305,949 | B1 * | 10/2001 | Okuyama | H01R 12/523 439/75 |

(Continued)

*Primary Examiner* — Harshad C Patel

(57) ABSTRACT

A power connector assembly includes a busbar having a mounting surface and openings extending into the busbar being open at the mounting surface and power contacts arranged in a power contact array electrically connected to the busbar. Each power contact includes a main body, a first compliant pin extending from the main body, and a second compliant pin extending from the main body. The first compliant pin is received in the corresponding opening of the busbar to electrically connect the power contact to the busbar. The second compliant pin is configured to be received in a plated via of a printed circuit board to electrically connect the power contact to the printed circuit board. The power contact array mechanically and electrically connects the busbar to the printed circuit board.

20 Claims, 4 Drawing Sheets

(56) References Cited

U.S. PATENT DOCUMENTS 6,428,329 B2 * 8/2002 Orui ..... H01R 43/205 439/82
6,592,382 B2 * 7/2003 Wurster ..... H01R 12/737 439/82
6,623,280 B2 * 9/2003 Oldenburg ..... H01R 12/52 439/75
6,729,899 B2 * 5/2004 Aekins ..... H01R 13/6464 439/404
6,840,783 B2 1/2005 Wolford et al.
7,083,431 B1 * 8/2006 Darr ..... H01R 13/642 439/943
7,220,151 B2 5/2007 Brehm et al.
7,618,283 B1 * 11/2009 Costello ..... H05K 1/142 439/511
7,963,796 B2 * 6/2011 Sypolt ..... H01R 12/732 439/511
8,075,321 B1 * 12/2011 Costello ..... H01R 12/585 439/77
8,118,611 B2 * 2/2012 Jeon ..... H01R 31/08 439/511
8,187,007 B2 * 5/2012 Emde ..... H01R 43/16 439/82
8,475,183 B2 * 7/2013 Chien ..... H01R 12/585 439/78
9,153,886 B2 * 10/2015 Nastasa ..... H01R 12/585
10,505,303 B2 * 12/2019 Hoyack ..... H05K 1/111
2008/0050947 A1 * 2/2008 Nunokawa ..... H01R 12/585 439/82
2008/0227315 A1 * 9/2008 Banno ..... H01R 12/58 439/82
2014/0273642 A1 * 9/2014 Weinstein ..... H01R 31/08 439/626
2015/0011114 A1 * 1/2015 Endo ..... H01R 13/58 439/449
2017/0179625 A1 * 6/2017 Xiao ..... H01R 12/523
2019/0153588 A1 * 5/2019 Boughton ..... C23C 16/4586

* cited by examiner

POWER CONNECTOR ASSEMBLY

BACKGROUND OF THE INVENTION

The subject matter herein relates generally to a power connector assembly.

Power connectors are used to supply power to components, such as a printed circuit board. Power is transmitted by the printed circuit board, via traces, to components connected to the printed circuit board. However, long trace lengths lead to poor power transfer due to resistance along the traces. Some systems supply the power in close proximity to the components. However, mounting the power connector to the printed circuit board requires fasteners that stress the printed circuit board when tightened, which may cause damage to nearby components or areas of the printed circuit board.

A need remains for a power connector assembly that may be coupled to a printed circuit board in a reliable manner.

BRIEF DESCRIPTION OF THE INVENTION in one embodiment, a power connector assembly is provided including a busbar having a mounting surface and openings extending into the busbar being open at the mounting surface and power contacts arranged in a power contact array electrically connected to the busbar. Each power contact includes a main body, a first compliant pin extending from the main body, and a second compliant pin extending from the main body. The first compliant pin is received in the corresponding opening of the busbar to electrically connect the power contact to the busbar. The second compliant pin is configured to be received in a plated via of a printed circuit board to electrically connect the power contact to the printed circuit board. The power contact array mechanically and electrically connects the busbar to the printed circuit board.

In another embodiment, a power connector assembly is provided including a busbar having a mounting surface and openings extending into the busbar being open at the mounting surface, and power contacts arranged in a power contact array electrically connected to the busbar. Each power contact includes a main body, a head at a first end of the power contact, and a tip at a second end of the power contact. The power contact has a first compliant pin between the main body and the head. The power contact has a second compliant pin between the main body and the tip. The power contact is loaded into the busbar and the printed circuit board in a loading direction with the tip passing through both the busbar and the printed circuit board. The head is coupled to the busbar. The first compliant pin is received in the corresponding opening of the busbar to electrically connect the power contact to the busbar. The second compliant pin is configured to be received in a plated via of the printed circuit board to electrically connect the power contact to the printed circuit board. The power contact array, mechanically and electrically connects the busbar to the printed circuit board.

In a further embodiment, a power connector assembly is provided including a busbar having a mounting surface facing a mounting surface of a printed circuit board. The busbar has openings extending into the busbar open at the mounting surface. The power connector assembly includes a carrier positioned between the busbar and the printed circuit board. The carrier has a first surface and a second surface and has carrier openings therethrough. The first surface faces the mounting surface of the busbar. The second surface faces the mounting surface of the printed circuit board. The power connector assembly includes power contacts arranged in a power contact array. The power contacts are received in corresponding carrier openings. Each power contact includes a main body, a first compliant pin extending from the main body, and a second compliant pin extending from the main body. The main body is coupled to and held by the carrier. The first compliant pin is received in the corresponding opening of the busbar to electrically connect the power contact to the busbar. The second compliant pin is configured to be received in a plated via of a printed circuit board to electrically connect the power contact to the printed circuit board. The power contact array mechanically and electrically connects the busbar to the printed circuit board.

DETAILED DESCRIPTION OF THE INVENTION

Figure 1:
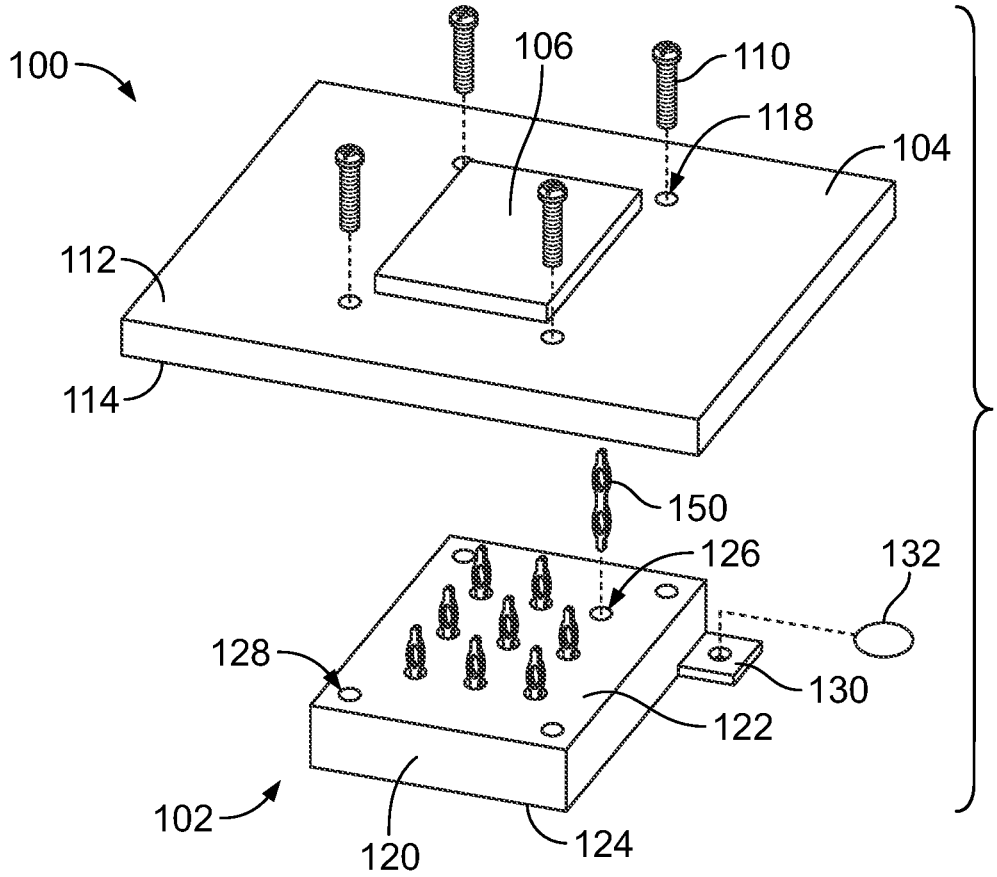
FIG. 1 illustrates an electrical system including a power connector assembly in accordance with an exemplary embodiment.

FIG. 1 illustrates an electrical system 100 including a power connector assembly 102 in accordance with an exemplary embodiment. The power connector assembly 102 is used to supply power to a printed circuit board 104, such as for powering one or more electrical components 106 coupled to the printed circuit board 104. In an exemplary embodiment, the power connector assembly 102 is electrically connected to the printed circuit board 104 proximate to the electrical component 106. As such, the length of power transmission along the printed circuit board 104, such as along conductive traces of the printed circuit board 104, is reduced for efficient power transfer to the electrical component 106. In an exemplary embodiment, the power connector assembly 102 has a press-fit connection interface to the printed circuit board 104.

The power connector assembly 102 includes a busbar 120 and power contacts 150 arranged in a power contact array coupled between the busbar 120 and the printed circuit board 104. The power contacts 150 provide mechanical and electrical connections between the busbar 120 and the printed circuit board 104. In an exemplary embodiment, the power contacts 150 are double-sided press-fit pin contacts. The press-fit interface between the power contacts 150 and the busbar 120 provide a reliable electrical interface between the power contacts 150 and the busbar 120. The press-fit interface between the power contacts 150 and the printed circuit board 104 provide a reliable electrical interface between the power contacts 150 and the printed circuit board 104 in an exemplary embodiment, the power contacts 150 are terminated to the busbar 120 and the printed circuit board 104 at solderless interfaces to reduce the risk of damage to the printed circuit board 104 of exposing the printed circuit board 104 to extreme temperatures during the soldering process. In an exemplary embodiment, the power contacts 150 provide a mechanical interface between the busbar 120 and the printed circuit board 104 to reduce or eliminate the need for securing hardware therebetween thus reducing the risk of damage to the printed circuit board 104 from the use of high clamping pressure from securing hardware. Strain and damage to the printed circuit board 104 is reduced with the use of the press-fit compliant pins of the power contacts 150.

The busbar 120 is manufactured from a metal material, such as copper or aluminum. The busbar 120 is a metal plate in various embodiments. The busbar 120 electrically connects each of the power contacts 150. Power is transmitted through the body of the busbar 122 each of the power contacts 150. The busbar 120 includes an upper surface 122 and a lower surface 124. In the illustrated embodiment, the upper surface 122 defines a mounting surface that faces the printed circuit board 104. The upper surface 122 may be referred to hereinafter as a mounting surface 122. In alternative embodiments, the lower surface 124 may define the mounting surface, such as when the busbar 120 is located above the printed circuit board 104.

The busbar 120 includes openings 126 extending at least partially through the busbar 120. The openings 126 are open at the mounting surface 122. The openings 126 receive corresponding power contacts 150. In the illustrated embodiment, the openings 126 have a circular cross-section; however, the openings 126 may have other shapes in alternative embodiments the openings 126 are sized and shaped to receive ends of the power contacts 150. For example, the openings 126 may have a width slightly smaller than the width of the end of the power contact 150 such that the power contacts are deformed when loaded into the openings 126 to form an interference fit between the power contacts 150 and the busbar 120. Optionally, the openings 126 may extend entirely through the busbar 120. In various embodiments, the openings 126 may be plated or coated with a conductive layer.

In an exemplary embodiment, the busbar 120 includes mounting openings 128 configured to receive fasteners 110 to secure the printed circuit board 104 to the busbar 120. However, in alternative embodiments, the busbar 120 may be coupled to the printed circuit board 104 using only the power contacts 150. For example, the press-tit interfaces provided by the power contacts 150 may be sufficient to mechanically coupled the busbar 120 into the printed circuit board 104.

In an exemplary embodiment, the busbar 120 includes a terminal 130 configured to be electrically connected to a power supply 132 that supplies power to the busbar 120. The terminal 130 may include a weld pad for welding a power wire to the terminal 130. In other various embodiments, the terminal 130 may include an opening to receive a power terminal. Other types of electrical connections may be provided in alternative embodiments.

The printed circuit board 104 includes an upper surface 112 and a lower surface 114. The printed circuit board 104 may include multiple layers between the upper surface 112 and the lower surface 114. The printed circuit board 104 includes printed circuits, such as traces, pads, vias, and the like extending through or along surfaces of the layers of the printed circuit board 104. In an exemplary embodiment, the lower surface 114 defines a mounting surface of the printed circuit board 104 and may be referred to hereinafter as a mounting surface 114. The mounting surface 114 faces the busbar 120. in alternative embodiments, the upper surface 112 may define a mounting surface that faces the busbar 120, such as when the printed circuit board 104 is located below the busbar 120.

In an exemplary embodiment, the printed circuit board 104 includes a plurality of plated vias 116 (shown in FIG. 2) that receive ends of the power contacts 150. The power contacts 150 are electrically connected to the printed circuit board 104 at the plated vias 116. The ends of the power contacts 150 may be press-fit into the plated vias 116. The busbar 120 is electrically connected to the electrical component 106 through the power contacts 150 and the plated vias 116.

In an exemplary embodiment, the printed circuit board 104 includes mounting openings 118 through the substrate of the printed circuit board 104 that receive the fasteners 110. The fasteners 110 are used to secure the printed circuit board 104 to the busbar 120. The fasteners 110 may be threaded fasteners. The fasteners 110 provide clamping pressure between the printed circuit board 104 in the busbar 120 to resist uncoupling of the busbar 120 from the printed circuit board 104 for the life of the electrical system 100. The amount of clamping force needed from the fasteners 110 is reduced by the positive mechanical connection provided by the press-fit connections of the power contacts 150.

Figure 2:
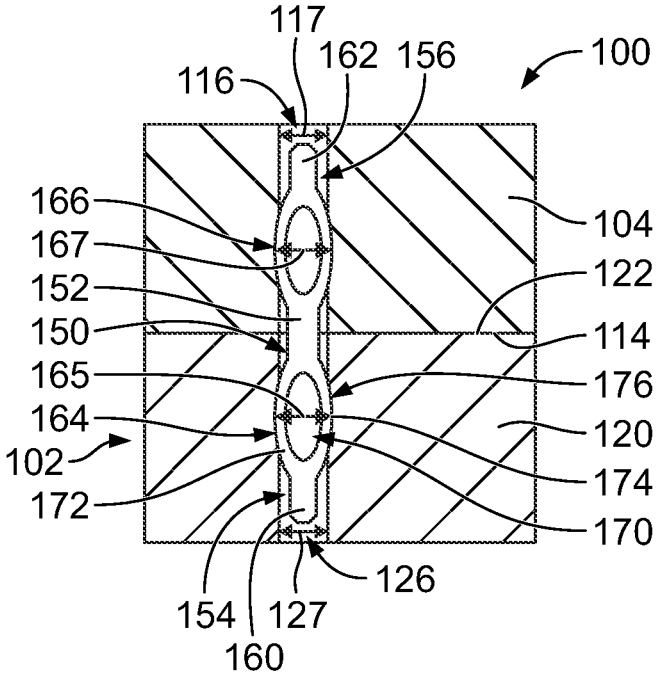
FIG. 2 is a cross-sectional view of a portion of the electrical system and the power connector assembly in accordance with an exemplary embodiment.

FIG. 2 is a cross-sectional view of a portion of the electrical system 100 in accordance with an exemplary embodiment. FIG. 2 illustrates the power connector assembly 102 coupled to the printed circuit board 104. The busbar 120 of the power connector assembly 102 is mechanically and electrically connected to the printed circuit hoard 104 by the power contact 150 (only one power contact 150 of the power contact array is illustrated in FIG. 2). The mounting surface 122 of the busbar 120 faces the mounting surface 114 of the printed circuit hoard 104. The power contact 150 spans the interface between the busbar 120 and the printed circuit board 104. The power contact 150 extends into the opening 126 of the busbar 120 and extends into the plated via 116 of the printed circuit board 104. Ends of the power contacts 150 are press-fit coupled to the busbar 120 and press-fit coupled to the printed circuit board 104.

The power contact 150 includes a main body 152 between a first end 154 and a second end 156. The power contact 150 is manufactured fr©m a metal material, such as a copper material. In an exemplary embodiment, the power contact 150 is a stamped and formed contact with the main body 152 being integral with the first end 154 and the second end 156. In the illustrated embodiment, the power contact 150 includes a first tip 160 at the distal end of the first end 154 and a second tip 162 at the distal end of the second end 156. The first tip 160 has a reduced cross-section to guide loading into the opening 126 of the busbar 120. The second tip 162 has a reduced cross-section to guide loading into the plated via 116 of the printed circuit board 104.

In an exemplary embodiment, the power contact 150 includes double-sided press-fit pins configured to be press-fit into the busbar 120 and into the printed circuit board 104. The power contact 150 includes a first compliant pin 164 at the first end 154 and a second compliant pin 166 at the second end 156. The first compliant pin 164 is configured to be press-fit to the busbar 120 in the opening 126. The second compliant pin 166 is configured to be press-fit into the printed circuit board 104 in the plated via 116. In the illustrated embodiment, the compliant pins 164, 166 are eye-of-the-needle pins. For example, each compliant pin 164, 166 includes an opening 170 flanked on opposite sides by a first compliant beam 172 and a second compliant beam 174. The compliant beams 172, 174 and the opening 170 form a compliant section. The compliant section 176 is configured to be deformed when press-fit into the busbar 120 or the printed circuit board 104 for example, the compliant beams 172, 174 may be compressed inward into the opening 170. Such compression causes elastic deformation of the compliant section 176, which causes the compliant beams 172, 174 to spring outward against the busbar 120 or the printed circuit board 104 to form a mechanical and electrical connection with the busbar 120 or the printed circuit board 104. The main body 152 connects the compliant sections 176.

In an exemplary embodiment, the first and second compliant pins 164, 166 may be identical to each other and inverted at opposite ends of the power contact 150. However, in alternative embodiments, the first and second compliant pins 164, 166 may be sized and shaped differently from each other. In an exemplary embodiment, the first compliant pin 164 has a first width 165 and the second compliant pin 166 has a second width 167. Optionally, the first and second widths 165, 167 may be equal to each other. However, in alternative embodiments, the first and second widths 165, 167 may be different from each other. In an exemplary embodiment, the opening 126 in the busbar 120 has an opening width 127. The first width 165 may be slightly greater than the opening width 127 such that the compliant section 176 of the first compliant pin 164 is compressed when the first compliant pin 164 is received in the opening 126. In an exemplary embodiment, the plated via 116 in the printed circuit board 104 has a via width 117. The second width 167 may be slightly greater than the via width 117 such that the compliant section 176 of the second compliant pin 166 is compressed when the second compliant pin 166 is received in the plated via 116. In the illustrated embodiment, the via width 117 is approximately equal to the opening width 127. However, the opening 126 may be wider than the plated via 116 in various embodiments, or vice versa.

Figure 3:
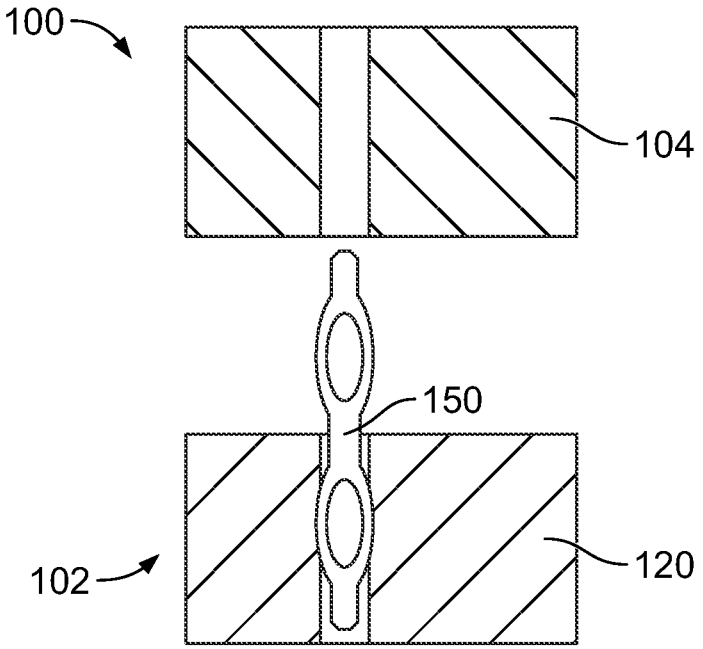
FIG. 3 is a cross-sectional view of a portion of the electrical system and the power connector assembly in accordance with an exemplary embodiment showing components of the electrical system during assembly.
Figure 4:
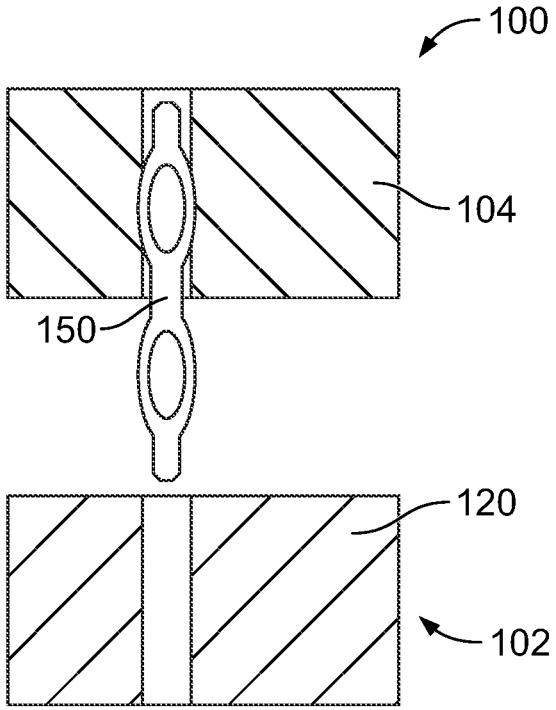
FIG. 4 is a cross-sectional view of a portion of the electrical system and the power connector assembly in accordance with an exemplary embodiment showing components of the electrical system during assembly.

FIG. 3 is a cross-sectional view of a portion of the electrical system 100 in accordance with an exemplary embodiment showing components of the electrical system 100 during assembly. FIG. 4 is a cross-sectional view of a portion of the electrical system 100 in accordance with an exemplary embodiment showing components of the electrical system 100 during assembly. FIG. 3 illustrates the power contact 150 coupled to the busbar 120 prior to assembly to the printed circuit board 104. FIG. 4 illustrates the power contact 150 coupled to the printed circuit board 104 prior to assembly to the busbar 120. The power contacts 150 may be preassembled to either component during assembly. In an exemplary embodiment, each of the power contacts 150 are preassembled to one of the components (for example the busbar 120 or the printed circuit board 104) prior to assembly of the busbar 120 with the printed circuit board 104. As such, all of the power contacts 150 may be mated to the other component (for example, the printed circuit board 104 or the busbar 120) simultaneously.

Figure 5:
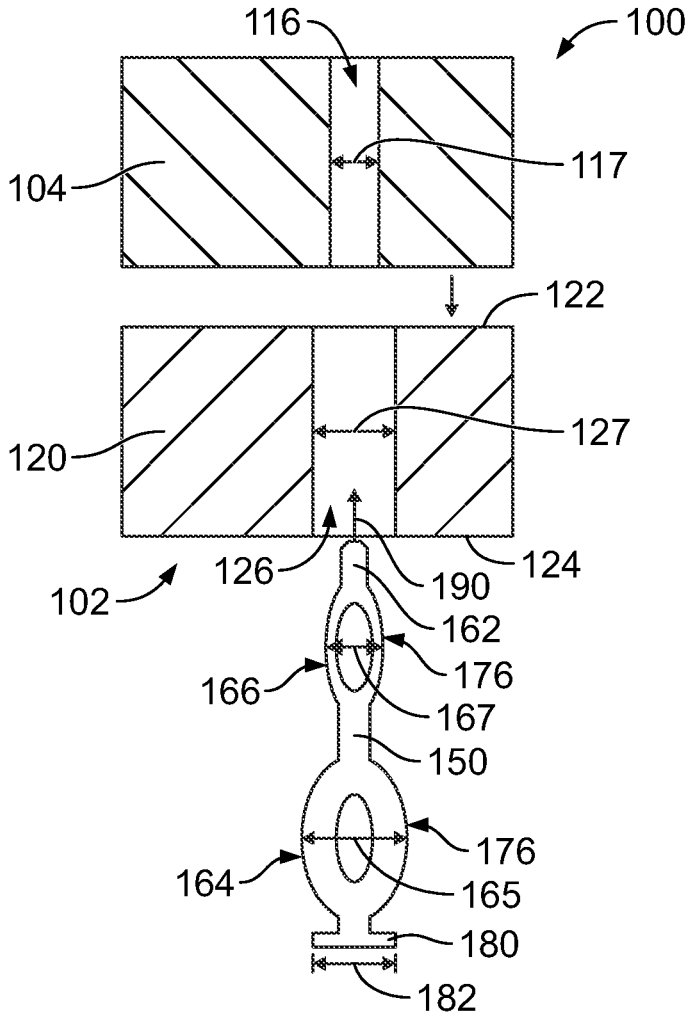
FIG. 5 is a cross-sectional view of a portion of the electrical system and the power connector assembly in accordance with an exemplary embodiment showing components of the electrical system during assembly.
Figure 6:
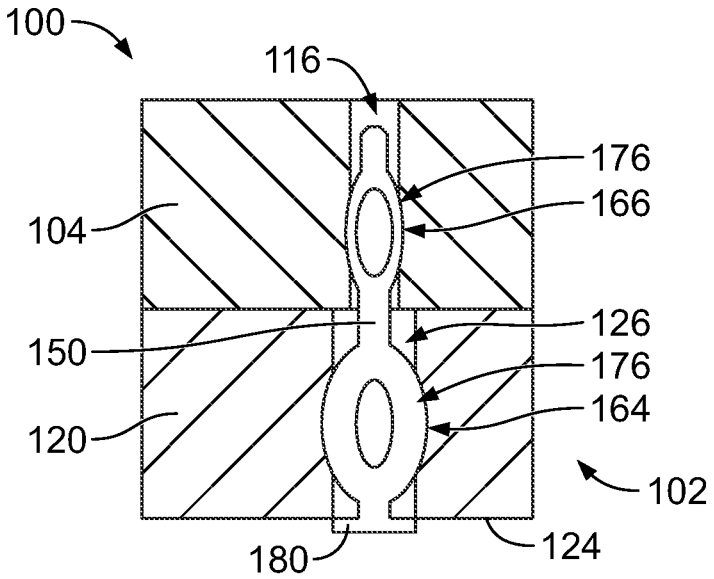
FIG. 6 is a cross-sectional view of a portion of the electrical system and the power connector assembly in accordance with an exemplary embodiment showing components of the electrical system in an assembled state.

FIG. 5 is a cross-sectional view of a portion of the electrical system 100 in accordance with an exemplary embodiment showing components of the electrical system 100 during assembly. FIG. 6 is a cross-sectional view of a portion of the electrical system 100 in accordance with an exemplary embodiment showing components of the electrical system 100 in an assembled state.

In an exemplary embodiment, the power contact 150 includes a head 180 at the first end 154. The head 180 is provided in lieu of the first tip 160 (shown in FIG. 2). The first compliant pin 164 is located between the main body 152 and the head 180. The second compliant pin 166 is located between the main body 152 and the second tip 162. In an exemplary embodiment, the power contact 150 is configured to be loaded into the busbar 120 and the printed circuit board 140 in a loading direction 190. The tip 162 passes through both the busbar 120 and the printed circuit board 140 as the power contact is loaded in the loading direction 190.

When assembled, the head 180 is configured to engage the busbar 120 (or the printed circuit board 104 when coupled to the printed circuit board 104) to locate the power contact 150 relative to the busbar 120. For example, during assembly, the power contact 150 may be loaded through the opening 126 until the head 180 bottoms out (i.e., abuts against) against the lower surface 124 of the busbar 120. Optionally, the head 180 may sit generally flush with the surface of the busbar 120. Optionally, the busbar 120 may include recessed notches that receive the head 180 such that the head 180 is recessed into the busbar 120. In an exemplary embodiment, the head 180 has a head width 182 greater than the opening width 127 of the opening 126. The head 180 provides a loading stop for the power contact 150 into the busbar 120.

In various embodiments, multiple heads 180 of different power contacts 150 may be connected together, such as by a connecting beam between the heads 180. For example, two of the power contacts 150 may be connected together to form a power staple defined by the two power contacts and the head 180, or connecting beam, therebetween. In other various embodiments, greater than two power contacts 150 may be ganged together in a row by connecting beams between each of the heads of the power contacts 150. For example, the power contacts 150 may be stamped with the connecting beams therebetween such that the power contacts 150 and the connecting beams are integral with each other formed from a single stamping process.

During assembly, the power contact 150 is loaded into the busbar 120 by initially passing the second compliant pin 166 through the opening 126 followed by the first compliant pin 164 being received in the opening 126. For example, the power contact 150 may be loaded through the busbar 120 through the lower surface 124. Optionally, the power contacts 150 may be preloaded into the busbar 120 prior to assembly and the power connector assembly 102 to the printed circuit board 104. However, in alternative assembly process, the busbar 120 and the printed circuit board 104 may be aligned with each other such that the openings 126 are aligned with the plated vias 116. The power contacts 150 may then be loaded into both the busbar 120 and the printed circuit board 104 in a single loading process. For example, the second compliant pin 166 passes through the opening 126 in the busbar 120 straight into the plated via 116 of the printed circuit board 104. As such, the assembly process may be simplified by simultaneously mating the first compliant pin 164 with the busbar 120 and the second compliant pin 166 with the printed circuit board 104. The power contact 150 is loaded into the busbar 120 and the printed circuit board 104 until the head 180 bottoms out against the busbar 120.

In an exemplary embodiment, to pass the second compliant pin 166 through the busbar 120 without damaging the compliant section 176 of the second compliant pin 166, the opening 126 is wider than the second width 167 of the second. compliant pin 166. As such, the second compliant pin 166 is able to pass, unobstructed lady, through the busbar 120. In the illustrated embodiment, the first compliant pin 164 is a first width 165 and is wider than the second width 167 of the second compliant pin 166. The first compliant pin 164 is wider for interfacing with the wider opening 126. The second compliant pin 166 is narrower for interfacing with the narrower plated via 116, In an exemplary embodiment, the head 180 allows the power connector assembly 102 to be disassembled. For example, for disassembly, the busbar 120 is separated from the printed circuit board 104. Movement of the busbar 120 away from the printed circuit board 104 pulls all of the power contacts 150 from of the plated vias of the printed circuit board 104. The heads 180 of the power contacts 150 allow disassembly of the printed circuit board 104 without damaging the printed circuit board 104 and without having any of the power contacts 150 stuck in the plated vias 116 of the printed circuit board 104. As such, the printed circuit board 104 may be reused, such as by coupling a different power connector assembly 102 to the printed circuit board 104.

Figure 7:
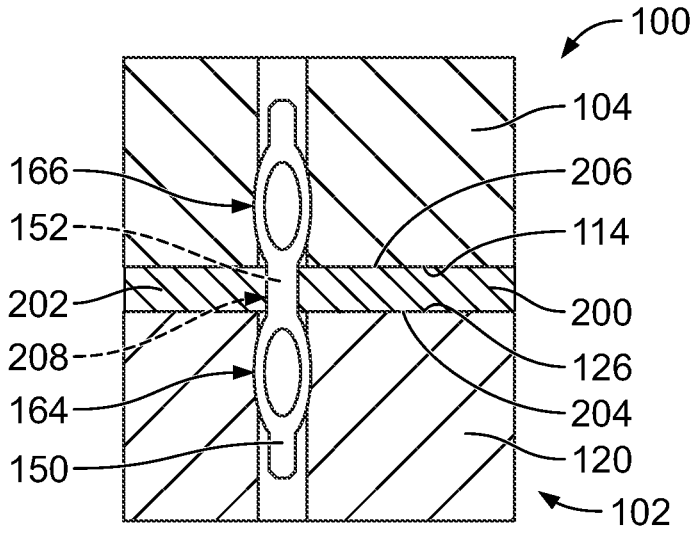
FIG. 7 is a cross-sectional view of a portion of the electrical system and the power connector assembly in accordance with an exemplary embodiment showing components of the electrical system in an assembled state.
Figure 8:
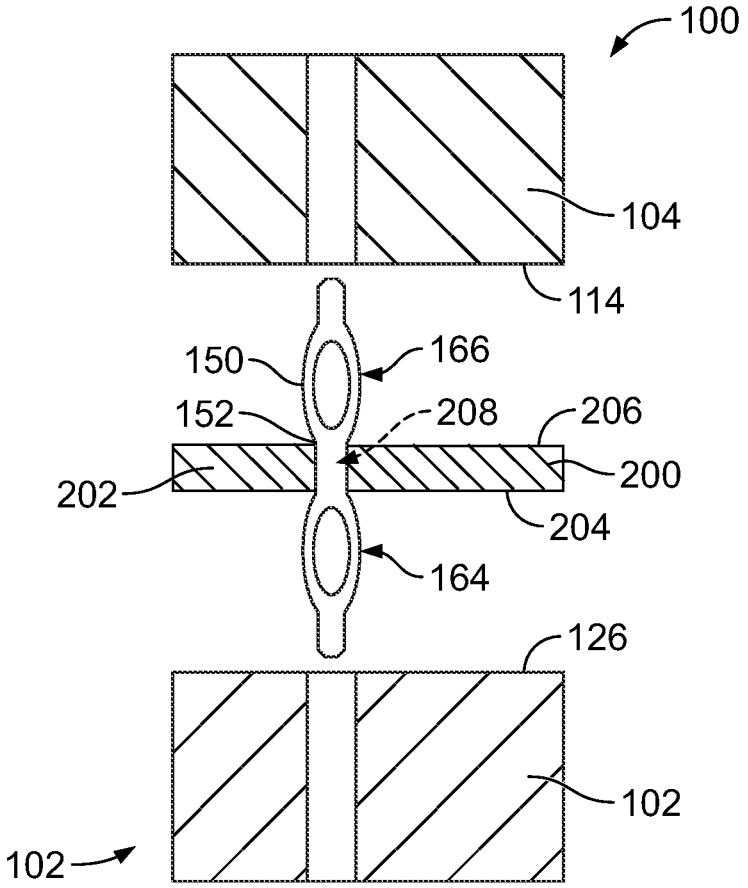
FIG. 8 is a cross-sectional view of a portion of the electrical system and the power connector assembly in accordance with an exemplary embodiment showing components of the electrical system during assembly.

FIG. 7 is a cross-sectional view of a portion of the electrical system 100 in accordance with an exemplary embodiment showing components of the electrical system 100 in an assembled state. FIG. 8 is a cross-sectional view of a portion of the electrical system 100 in accordance with an exemplary embodiment showing components of the electrical system 100 during assembly.

In an exemplary embodiment, the power connector assembly 102 includes a carrier 200 used to hold the power contacts 150 and the power contact array. When assembled, the carrier 200 is located between the mounting surfaces 122, 114 of the busbar 120 and the printed circuit board 104. The carrier 200 includes a substrate 202 that ties each of the power contacts 150 together as a unit. The carrier 200 makes assembly to the busbar 120 and/or the printed circuit board 104 simpler. In various embodiments, the carrier 200 may be a flexible film. In other various embodiments, the carrier 200 may be a rigid plate. Optionally, the carrier 200 may be electrically conductive to electrically connect to each of the power contacts 150. In alternative embodiments, the carrier 200 may be manufactured from a dielectric material to provide electrical isolation between the busbar 120 and the mounting surface 114 of the printed circuit board 104, The carrier 200 includes a first surface 204 and a second surface 206. The first surface 204 faces the mounting surface 122 of the busbar 120 and may be a bottom side in various embodiments. The second surface 206 faces the mounting surface 114 of the printed circuit board 104 and may be a top side in various embodiments. In an exemplary embodiment, the carrier 200 includes openings 208 therethrough. The openings 208 receive the main bodies 152 of the power contacts 150. In various embodiments, the carrier 200 may be formed in place around the array of the power contacts 150. For example, the carrier 200 may be molded around the main bodies 152 of the power contacts 150. The first compliant pins 164 extend from the first surface 204. The second compliant pins 166 extend from the second surface 206. The first compliant pins 164 are used to secure the carrier 200 to the busbar 120. The second compliant pins 166 are used to secure the carrier 200 to the printed circuit board 104.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A power connector assembly comprising:

a busbar having a mounting surface, the busbar including a metal block having openings extending into the metal block of the busbar, the openings being open at the mounting surface; and power contacts arranged in a power contact array, the power contacts being electrically connected to the metal block of the busbar to electrically common the power contacts, each power contact including a main body, a first compliant pin extending from the main body, and a second compliant pin extending from the main body, the first compliant pin being received in the corresponding opening of the busbar to electrically connect the power contact to the busbar, the second compliant pin configured to be received in a plated via of a printed circuit board to electrically connect the power contact to the printed circuit board, wherein the power contact array mechanically and electrically connects the metal block of the busbar to the printed circuit board through the power contacts of the power contact array.

2. The power connector assembly of claim 1, wherein the power contacts are double ended-press fit pins.

3. The power connector assembly of claim 1, wherein the first compliant pin has a first width and the second compliant pin has a second width approximately equal to the first width.

4. The power connector assembly of claim 1, wherein the openings in the busbar each have an opening width, the first compliant pin having a first width greater than the opening width, the second compliant pin having a second width less than the opening width.

5. The power connector assembly of claim 1, wherein the power contact includes a head at a first end of the power contact, the head being wider than the busbar opening to rest on the busbar when the power contact is coupled to the busbar.

6. The power connector assembly of claim 1, wherein a plurality of the power contacts are coupled together by a connecting beam, the connecting beam abutting against the busbar when the power contacts are coupled to the busbar.

7. The power connector assembly of claim 1, wherein the power contact has a first tip and a second tip at opposite ends of the power contact, the first compliant pin located between the main body and the first tip, the second compliant pin located between the main body and the second tip.

8. The power connector assembly of claim 1, further comprising a carrier holding a plurality of the power contacts, the carrier having a first surface and a second surface, the first compliant pins extending from the first surface, the second compliant pins extending from the second surface, the carrier located between the busbar and the printed circuit board.

9. The power connector assembly of claim 8, wherein the carrier is a flexible film.

10. The power connector assembly of claim 8, wherein the first compliant pins secure the carrier to the busbar, and wherein the second compliant pins secure the carrier to the printed circuit board.

11. The power connector assembly of claim 1, wherein the busbar has a terminal configured to be electrically connected to a power supply that supplies power to the busbar.

12. A power connector assembly comprising:

a busbar having a mounting surface, the busbar including a metal block having openings extending into the metal block of the busbar, the openings being open at the mounting surface; and power contacts arranged in a power contact array, the power contacts being electrically connected to the metal block of the busbar to electrically common the power contacts, each power contact including a main body, a head at a first end of the power contact, and a tip at a second end of the power contact, the power contact having a first compliant pin between the main body and the head, the power contact having a second compliant pin between the main body and the tip, the power contact being loaded into the busbar and a printed circuit board in a loading direction with the tip passing through both the busbar and the printed circuit board, the head being coupled to the busbar, the first compliant pin being received in the corresponding opening of the busbar to electrically connect the power contact to the busbar, the second compliant pin configured to be received in a plated via of the printed circuit board to electrically connect the power contact to the printed circuit board, wherein the power contact array mechanically and electrically connects the metal block of the busbar to the printed circuit board through the power contacts of the power contact array.

13. The power connector assembly of claim 12, wherein the second compliant pin passes through the busbar into the corresponding plated via during loading to electrically connect the second compliant pin to the printed circuit board.

14. The power connector assembly of claim 12, wherein the first compliant pin is loaded into the busbar from above and wherein the second compliant pin is loaded into the busbar from above.

15. The power connector assembly of claim 12, wherein the openings in the busbar each have an opening width, the first compliant pin having a first width greater than the opening width, the second compliant pin having a second width less than the opening width.

16. The power connector assembly of claim 12, wherein the openings in the busbar each have an opening width, and wherein the plated vias each have a via width less than the opening width.

17. The power connector assembly of claim 12, wherein the openings are aligned with the plated vias to allow the power contacts to pass straight through the openings and the plated vias during loading.

18. A power connector assembly comprising:

a busbar having a mounting surface facing a mounting surface of a printed circuit board, the busbar including a metal block having openings extending into the metal block of the busbar, the openings being open at the mounting surface;

a carrier positioned between the busbar and the printed circuit board, the carrier having a first surface and a second surface, the carrier including carrier openings therethrough, the first surface facing the mounting surface of the busbar, the second surface facing the mounting surface of the printed circuit board;

power contacts arranged in a power contact array, the power contacts being received in corresponding carrier openings, each power contact including a main body, a first compliant pin extending from the main body, and a second compliant pin extending from the main body, the main body being coupled to and held by the carrier, the first compliant pin being received in the corresponding opening of the busbar to electrically connect the power contact to the metal block of the busbar to electrically common the power contacts, the second compliant pin configured to be received in a plated via of a printed circuit board to electrically connect the power contact to the printed circuit board, wherein the power contact array mechanically and electrically connects the metal block of the busbar to the printed circuit board through the power contacts of the power contact array.

19. The power connector assembly of claim 18, wherein the carrier is a flexible film.

20. The power connector assembly of claim 18, wherein the first compliant pins secure the carrier to the busbar, and wherein the second compliant pins secure the carrier to the printed circuit board.

* * * * *